United States Patent [19]

Pirrallo

[11] Patent Number: 4,509,579

[45] Date of Patent: Apr. 9, 1985

[54] APPARATUS FOR FLUIDIZING A PARTICULATE BED WITHIN A FLASK

[75] Inventor: Frank G. Pirrallo, Fraser, Mich.

[73] Assignee: General Motors Corporation, Detroit, Mich.

[21] Appl. No.: 622,476

[22] Filed: Jun. 20, 1984

[51] Int. Cl.[3] ..... B22D 21/12; B22D 19/00

[52] U.S. Cl. ..... 164/159; 164/34; 164/412

[58] Field of Search ..... 164/34, 35, 412, 159; 34/579; 422/139, 143

[56] References Cited

U.S. PATENT DOCUMENTS

| | | | |
|---|---|---|---|
| 3,293,768 | 12/1966 | Blank et al. | 34/57 A |
| 3,557,867 | 1/1971 | Krzyzanowski | 164/34 X |
| 3,678,989 | 7/1972 | Krzyzanowski | 164/34 X |
| 3,741,281 | 6/1973 | Hauser-Lienhard | 164/253 |
| 3,842,899 | 10/1974 | Hauser-Lienhard | 164/253 |

*Primary Examiner*—Nicholas P. Godici

*Assistant Examiner*—Kenneth F. Berg

*Attorney, Agent, or Firm*—Douglas D. Fekete

[57] ABSTRACT

A fluidization apparatus is adapted for use with a flask containing a particulate bed, for example, a foundry flask used in lost foam metal casting. The apparatus comprises a reciprocal plenum box defining a plenum having a gas outlet and receivable within the flask such that the plenum outlet registers with a perforated partition supporting the particulate bed within the flask. The plenum outlet is covered by an air filter suitable for removing contaminants from compressed air. The plenum box also carries a resilient seal member located about the plenum outlet. When the box is received in the flask, pneumatic lifts mounted upon the box raise the box to seal the box against the partition. Compressed air admitted to the plenum flows from the plenum outlet through the filter, which removes entrained contaminants that might otherwise plug the partition, and thereafter through the partition to fluidize the particulate bed.

2 Claims, 6 Drawing Figures

APPARATUS FOR FLUIDIZING A PARTICULATE BED WITHIN A FLASK

BACKGROUND OF THE INVENTION

This invention relates to an apparatus for fluidizing an unbonded particulate bed of the type used to form a foundry mold in casting metal by a lost foam process. More particularly, this invention relates to an apparatus suitable for use with a flask containing an unbonded particulate bed supported upon a gas-permeable partition to force gas through the partition to fluidize the bed, while reducing plugging of the partition by contaminants entrained in the gas.

In a lost foam casting process, a bed of unbonded refractory particles such as loose sand is packed about a polymeric pattern to form a foundry mold. Molten metal poured into the mold decomposes and replaces the pattern to produce a product casting. To embed the delicate pattern, the bed is temporarily fluidized by an intermittent upward forceful gas flow. The pattern is submerged in the fluidized bed and the gas flow is terminated, whereupon the sand compacts about the pattern. The particulate mold may also be fluidized to facilitate removal of the casting.

Accordingly, a typical foundry flask for lost foam casting comprises a box whose interior is divided by a perforated partition into an upper mold compartment containing the particulate bed and a lower plenum. A gas line is connected to the box to introduce gas under pressure into the plenum, whereupon the gas flows through the partition to fluidize the bed. The perforated partition retains the refractory particles of the bed while allowing gas flow therethrough. Dirt or oil entrained in the pressurized gas introduced in the plenum tends to plug the partition, resulting in uneven fluidization. To obtain access to the partition and plenum for cleaning, it is necessary to disassemble the flask, which removes the flask from production for an extended time. In a production operation involving a plurality of flasks, considerable effort may be needed to maintain the many flasks.

Also, in a typical foundry operation, the flask is conveyed among a plurality of work stations and the gas line is intermittently connected to the flask only at those stations where fluidization is required. It is preferred to connect the gas line automatically, as opposed to manually. This is suitably accomplished by a lance inserted into the plenum through an opening in the flask. Sealing members are provided between the lance and the flask. Foundry dirt accumulating on the lance is introduced into the plenum, adding to the problem of partition plugging, and wears the sealing members about the lance, thereby reducing the effectiveness of the seal and necessitating replacement of the sealing members.

Therefore, it is an object of this invention to provide a fluidization apparatus for use with a flask, such as a lost foam foundry flask, containing an unbonded particulate bed supported upon a gas-permeable partition, which apparatus comprises a plenum adapted to automatically combine with the flask at desired times to force gas through the partition to fluidize the bed, but to disengage from the flask at other times, thereby permitting the flask to be conveyed unencumbered to other work stations. The plenum filters dirt, oil or other contaminants entrained in the gas prior to flowing through the partition, thereby reducing plugging of the partition. When disengaged, the plenum is accessible for cleaning and related maintenance. In a production operation involving many flasks, periodic maintenance conveniently performed on the readily accessible plenum, as opposed to the many flasks, reduces overall maintenance for the operation and allows the flasks to remain in production. In addition, gas is fed to the plenum through a line continually connected thereto, thereby avoiding the problems associated with making temporary gas line connections.

SUMMARY OF THE INVENTION

In a preferred embodiment of this invention, a fluidization apparatus is located at a work station of a lost foam metal casting facility and intended to act upon a foundry flask conveyed to the work station. The flask contains an unbonded sand bed supported upon a perforated partition and comprises an open base that provides access to a face of the partition opposite the bed. The base also includes a platform spaced apart from the partition.

The fluidization apparatus comprises a plenum box defining a plenum and connected to a pressurized air line that communicates with the plenum for introducing compressed air therein. The plenum includes a gas outlet corresponding in size and shape to the partition exposed within the flask base. The outlet is preferably covered by an air filter to trap and remove dirt or oil. The box reciprocates between an outboard position wherein the box is located apart from the foundry flask and an inboard position wherein the box is received within the flask base such that the box rests upon the platform therein and the gas outlet registers with the exposed permeable partition. Suitable clearance is provided to allow the box to be moved between positions without interference by the partition. Pneumatic lifts are mounted upon the plenum box and expand in response to pressurized air to act upon a surface upon which the box rests to raise the box therefrom. The box carries a peripheral seal member located about the plenum gas outlet and suitable for forming a hermetic seal when pressed against a cooperating surface.

At appropriate stages of the lost foam casting operation, the foundry flask is conveyed into position at the fluidization work station while the plenum box is in the outboard position. The box is advanced into the flask base so as to rest upon the platform therein with the plenum gas outlet and the flask partition in registry. This advance is facilitated by the provided clearance. The pneumatic lifts are actuated to raise the box above the platform into confrontation with the partition, whereupon the seal member engages the partition to form a peripheral hermetic seal about the plenum outlet. Pressurized air introduced into the plenum exits through the plenum outlet and the permeable partition to fluidize the sand bed. Dirt or oil carried by the pressurized gas is removed by the filter to prevent plugging of the partition. Depending upon the particular stage of the lost foam process, a vaporizable pattern may be embedded within the fluidized bed or a product casting may be removed therefrom. Thereafter, the flow of pressurized gas to the plenum is terminated, so that the bed returns to a packed state. The pneumatic lifts are vented, whereupon the box is lowered and clearance within the flask base is reestablished. The box is retracted from the flask and returned to the outboard position, thereby freeing the flask for conveyance to another work station.

Thus, in accordance with this invention, the fluidization apparatus only temporarily engages a foundry flask during periods when fluidization is desired. At other times, the plenum box is withdrawn from the flask. In the outboard position, the plenum box is readily accessible for periodic cleaning and other maintenance, including replacement of the filter or seal member. This plenum maintenance is performed without disassembling the flask. By filtering the air and maintaining the plenum clean, plugging of the partition is reduced, thereby reducing the maintainance effort required to permit the flask to remain in use. Also, during operations, the air line is continuously coupled to the box to avoid the problems associated with making frequent, temporary air line connections.

DESCRIPTION OF THE DRAWINGS

The present invention will be further illustrated with reference to the accompanying drawings wherein.

DETAILED DESCRIPTION OF THE INVENTION

Figure 1:
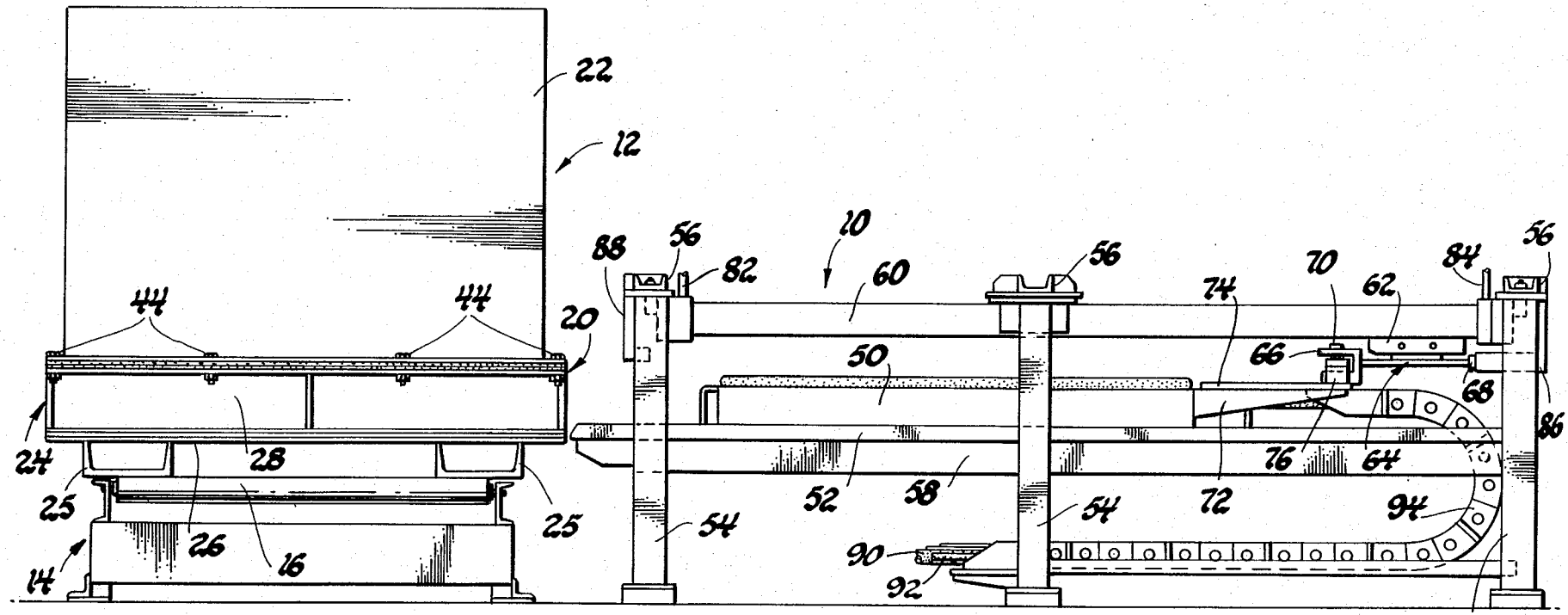
FIG. 1 is a plan view showing a foundry flask and a fluidization apparatus of this invention, wherein the fluidization apparatus is withdrawn from the flask.

Referring to the figures, a preferred embodiment of this invention comprises a fluidization apparatus 10 intended for use in combination with an open-top, rectangular foundry flask 12 in a lost foam metal casting operation. Flask 12 travels along a conveyor 14 comprising a series of rollers 16. Conveyor 14 carries a plurality of flasks 12 between multiple work stations whereat various tasks are carried out, including positioning a polystyrene pattern within the flask, pouring molten metal into the flask to decompose and replace the pattern, cooling to solidify the metal, and removing a product casting from the flask. Flask 12 contains a bed 18 of loose sand, shown in FIGS. 3 through 5, which bed is accessible from above the flask. In accordance with typical lost foam casting practice, sand bed 18 is fluidized to embed a pattern. Also, the sand bed may be fluidized to facilitate removal of a product casting from the flask. Thus, fluidization apparatus 10 moves to and stops at a work station along conveyor 14 whereat either pattern embedding or casting removal is performed. Apparatus 10 is directed to fluidizing the bed within flask 12 regardless of the particular task to be performed therein. After the bed is fluidized, other equipment also located at the work station, but not shown, may act upon the fluidized bed from above to accomplish the desired task.

Within flask 12, sand bed 18 rests upon a dual-layer, gas-permeable partition 20 and is confined within rectangular solid-wall container 22. Flask 12 comprises an open base 24 including channel-iron legs 25 that ride over conveyor rollers 16. Legs 25 support a horizontal platform 26. Platform 26 is parallel to, but spaced apart from, partition 20 by opposite, parallel angle-iron walls 28, thereby defining a chamber 30 through base 24, shown in FIG. 3. Base chamber 30 is separated from sand bed 18 by partition 20. Base 24 is open between walls 28 to permit access to chamber 30 and thus access to partition 20 at a face opposite and beneath bed 18. Foundry flask 12 rides upon conveyor 14 such that base walls 28 face forwardly and rearwardly and base chamber 30 is accessible from a position to the side of conveyor 14, which position is occupied by fluidization apparatus 10 at the work station, as shown in FIGS. 1 and 2.

Figure 3:
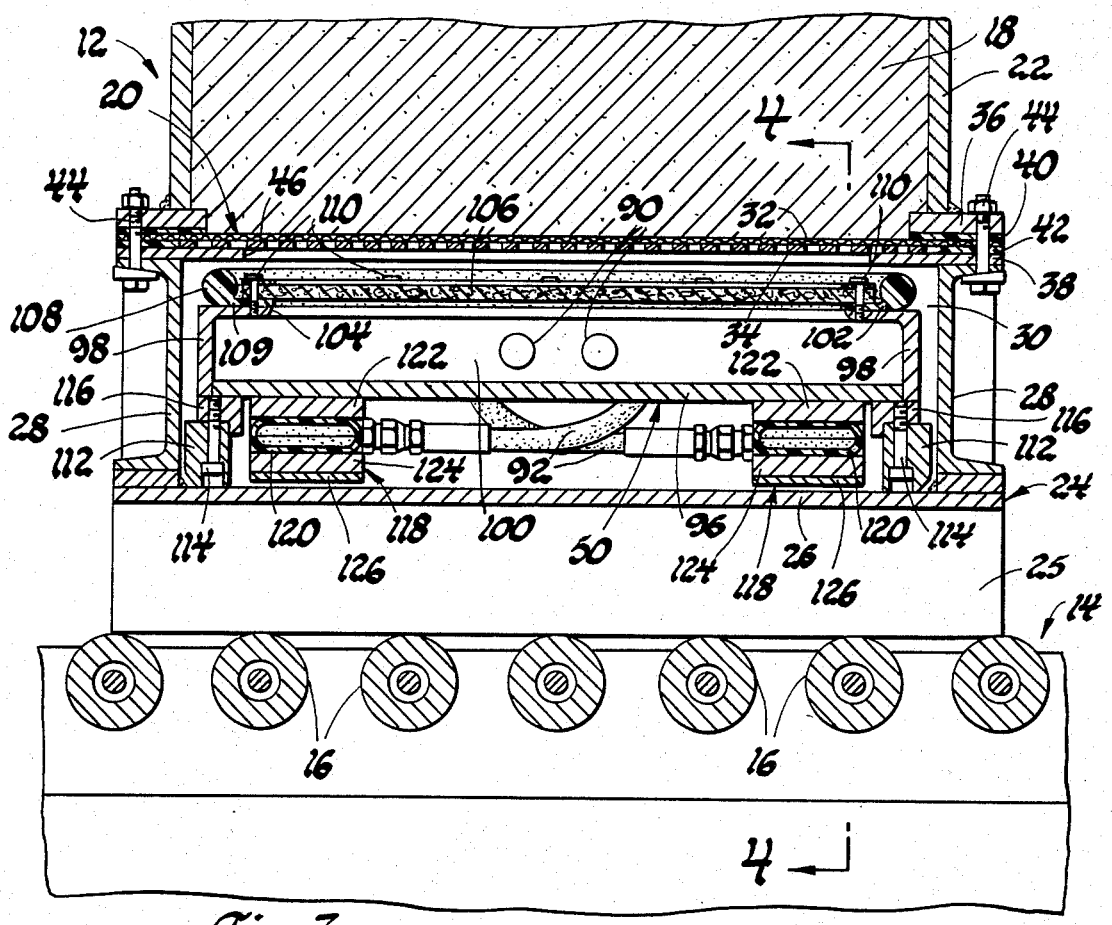
FIG. 3 is a cross sectional view taken along the line 3—3 in FIG. 2.
Figure 4:
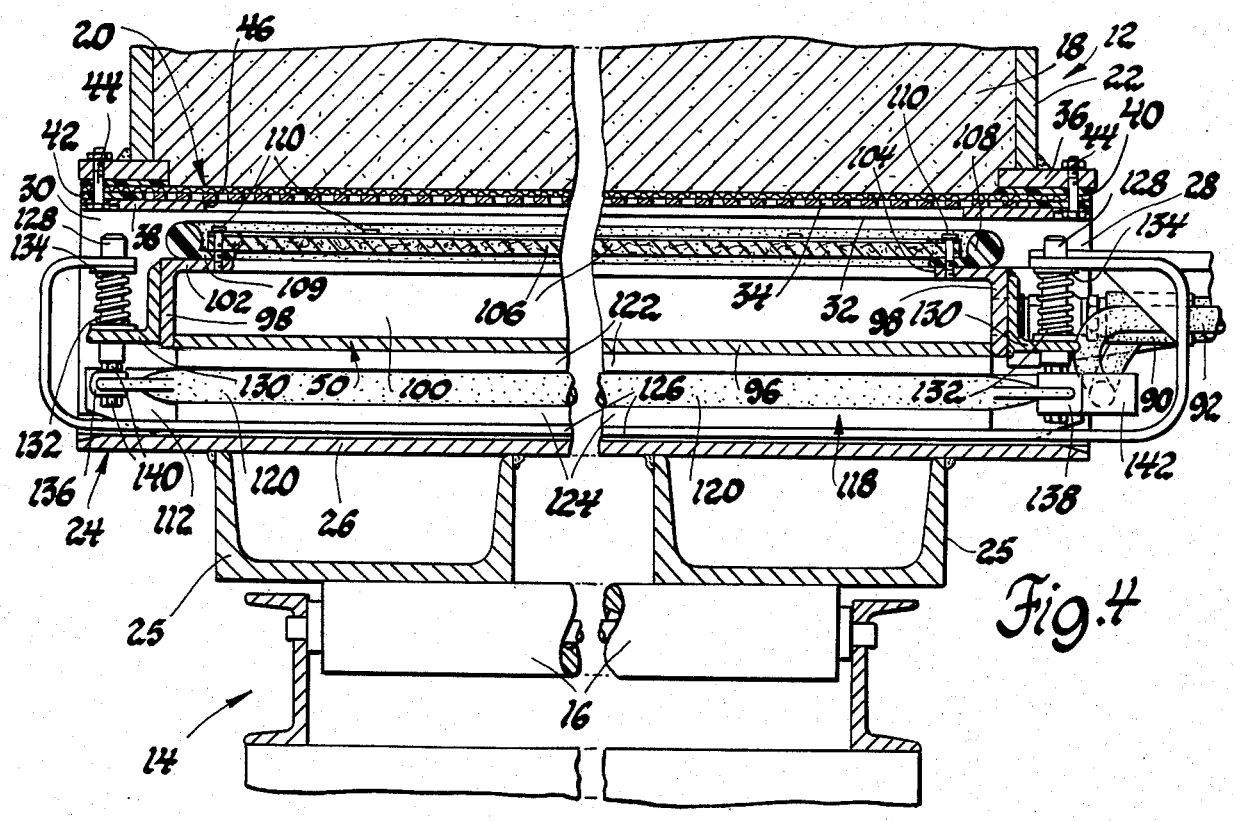
FIG. 4 is a cross sectional view taken along the line 4—4 in FIG. 3.
Figure 5:
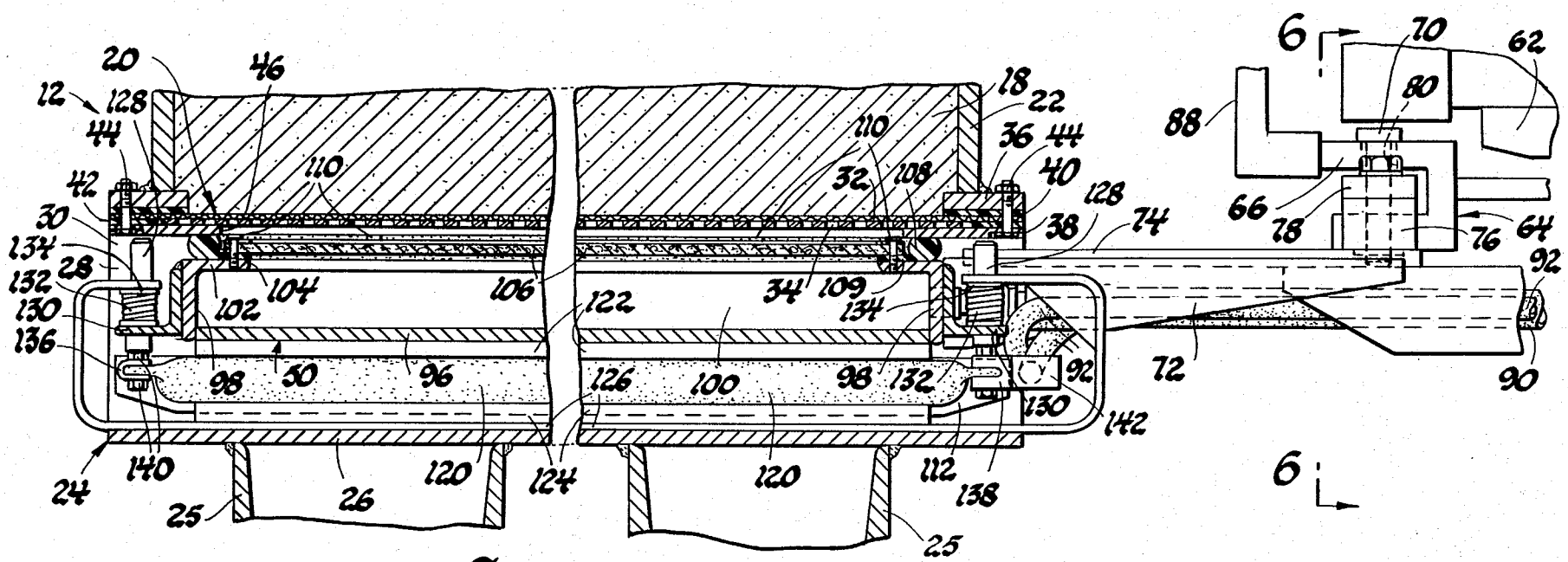
FIG. 5 is a cross sectional view similar to FIG. 4, but showing the arrangement of the apparatus and the flask during fluidization.

The construction of partition 20 is shown in FIGS. 3 through 5. Partition 20 is formed of a wire mesh laminate 32 immediately adjacent sand bed 18 and an expanded metal screen 34 facing chamber 30. Laminate 32 is formed of a plurality of wire mesh laminae pressed into an integral sheet. The laminate retains sand particles that form bed 18, but has perforations that permit gas flow therethrough. A suitable laminate is available from the Michigan Dynamics, Inc., Garden City, Mich., under the trade designation Dynapore Wire Mesh Laminate. Expanded metal screen 34 reinforces laminate 32 in supporting the weight of sand bed 18. Laminate 32 and screen 34 are sandwiched about the perimeter between a flange 36 perpendicularly welded to container 22 and a frame member 38 that sits upon base walls 28. A gasket 40 lies between flange 36 and laminate 32. The perimeter of screen 34 is slightly reduced in comparison to laminate 32 and a second gasket 42 is arranged between laminate 32 and frame 38 surrounding screen 34. Gaskets 40 and 42 form a hermetic seal about the perimeter of partition 20. Flange 36 and frame 38 are joined by a series of bolts 44. Where applicable, bolts 44 also join base walls 28 to secure container 22 and partition 20 to flask base 24. Frame 38 defines an opening 46 covered by permeable members 32 and 34 through which air may pass into bed 18, but extends inwardly to provide a border surrounding opening 46 facing chamber 30 suitable for forming a seal thereagainst.

Figure 2:
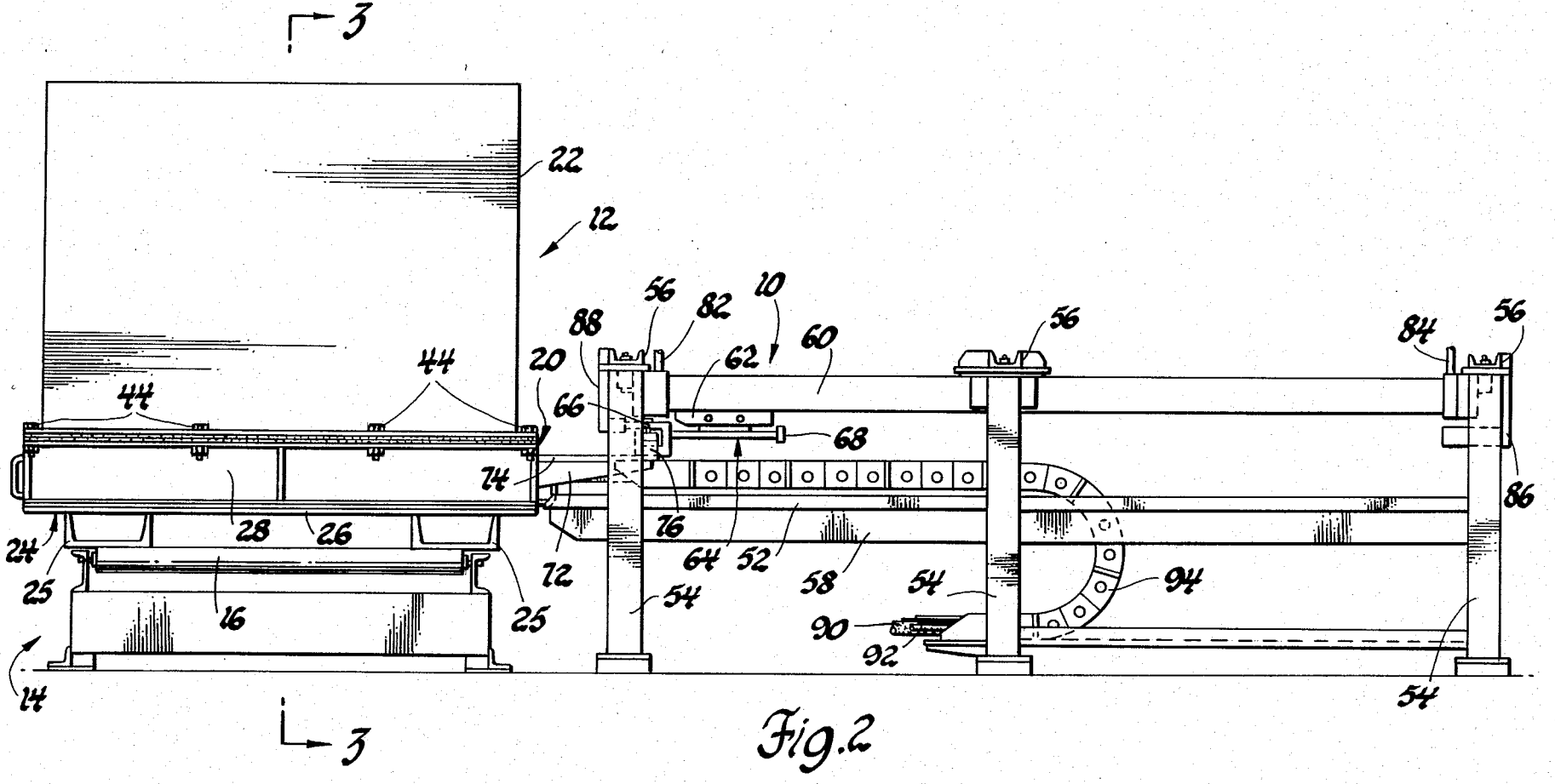
FIG. 2 is a plan view of the foundry flask and the fluidization apparatus of FIG. 1, but wherein the fluidization apparatus is combined with the flask.

Apparatus 10 comprises a shuttle plenum box 50 slidably reciprocal along a path between an outboard, inactive position shown in FIG. 1 wherein the box is independent of flask 12 and an inboard position shown in FIG. 2 wherein the box is extended within flask base 24. In the inboard position, box 50 is received within flask base chamber 30 resting upon platform 26, as shown in FIGS. 3 through 5. Also in the inboard position, box 50 is liftable from a lowered position shown in FIGS. 3 and 4 wherein clearance is provided between box 50 and flask partition 20 to permit the box to enter and exit flask base 24, and a raised position shown in FIG. 5 wherein box 50 confronts flask partition 20 for fluidization.

Box 50 rides upon parallel, horizontal angle-iron rails 52 mounted upon pillars 54. Pillars 54 are arranged in pairs and connected transverse to the path of box 50 by cross beams 56. Pillars 54 are braced parallel to rails 52 by beams 58. Rails 52 are mounted at an elevation equivalent to platform 26 of flask 12 on conveyor 14 so that, when flask 12 is positioned at the work station, rails 52 are coplanar with platform 26 and cooperate to form a substantially continuous track for sliding shuttle box 50 between the inboard and outboard positions.

Figure 6:
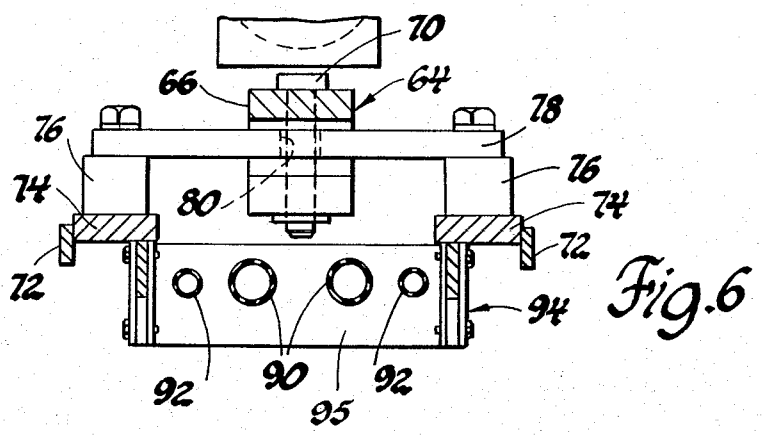
FIG. 6 is a partial view showing details of a connection and taken along line 6—6 in FIG. 5 looking in the direction of the arrows.

Box 50 is moved between inboard and outboard position by a rodless air cylinder 60 that is mounted upon cross beams 56 and actuates a shuttle 62 reciprocal parallel to the path of box 50. Shuttle 62 and box 50 are connected such that the shuttle is offset away from conveyor 14 relative to box 50 to permit box 50 to be extended over conveyor 14 for positioning within flask 12 resting upon the conveyor. Fixed to shuttle 62 is a bracket 64 comprising a yoke 66 and an end 68 spaced along the path of box 50 adjacent and remote relative to box 50. Referring to FIGS. 5 and 6, yoke 66 carries a connecting pin 70 oriented transverse to the path of box 50. Fixed to box 50 are triangular plates 72 extending parallel to the path of the box in the direction of shuttle 62. Plates 72 are welded to and support a cover plate 74. Mounts 76 fixed upon cover plate 74 are connected by a member 78 having a bore 80 wherethrough pin 70 is slidably inserted. Plate 74 is cutaway beneath pin 70 and sufficient clearance is provided between yoke 66 and member 78. This connection is provided with sufficient clearance to allow pin 70 to slide within bore 80 to accommodate the lifting of box 50 in the inboard position. The position of shuttle 62 shown in FIG. 1, and thus the outboard position of box 50, is determined by a stop 86 mounted from an end cross beam 56 for engaging bracket end 68. The position of shuttle 62 in FIG. 2, and thus box 50 in the inboard position, is similarly determined by a stop 88 mounted from a crossbeam 56 that engages yoke 66. Rodless air cylinder 60 is connected at opposite ends to air lines 82 and 84 for selectively admitting compressed air to actuate shuttle 62 and thereby move box 50 between the inboard and outboard positions. Intermittent pressurized air admitted through line 82, while venting through line 84, pushes shuttle 62 to the outboard position shown in FIG. 1 wherein bracket end 68 abuts stop 86. Alternately, intermittent pressurized air through line 84, while venting through line 82, pushes shuttle 62 into the inboard position shown in FIG. 2 wherein yoke 66 abuts stop 88.

Box 50 is connected to two larger diameter pressurized air lines 90 and two smaller diameter pressurized air lines 92 that loop below rails 52 to accommodate the motion of box 50 between positions without entanglement and are disposed within a flexible hose carrier 94 comprising a series of holding plates 95.

The construction of plenum box 50 is more particularly shown in FIGS. 3 through 5. Box 50 is formed of a bottom plate 96 and rectangularly arranged side walls 98 that cooperate to define a plenum 100. Larger diameter air hoses 90 connected to box 50 communicate with plenum 100 for introducing pressurized air therein. Walls 98 comprise an inwardly extending upper flange 102 that defines a rectangular outlet 104 from plenum 100. Outlet 104 corresponds in size approximately with opening 46 of frame 38. Outlet 104 is covered by a fiberglass air filter 106. A resilient polymeric seal bead 108 rests upon flange 102 surrounding outlet 104. Bead 108 comprises a connecting flange 109 that is coanchored with filter 106 to flange 102 by bolts 110.

Box 50 is supported by skids 112 attached by bolts 114 to blocks 116 fixed to plate 96. Skids 112 are slidable along rails 52 and flask base platform 26 to carry box 50 between the inboard and outboard positions. When box 50 is in the inboard position received with flask base 24, skids 112 support box 50 such that plenum outlet 104 registers with opening 46 in partition frame 38 and surrounding seal bead 108 is adjacent the frame 38.

When box 50 is received within flask base 24, skids 112 support plenum base 96 spaced apart from platform 26. Mounted upon box 50 beneath plate 96 are two pneumatic lifts 118. Each lift 118 comprises a pressurized air inflatable bag 120 formed of a resilient material and adapted to expand vertically in response to increased air pressure therein. Air bag 120 is sandwiched between a steel plate 122 fixed to plenum box base 96 and a second steel plate 124 fixed to a bracket 126 extending beneath bag 120. The ends of bracket 126 curve upwardly in a "C" shape. Pins 128 extend slidably through the ends of bracket 126 and also through guide flanges 130 fixed to plenum walls 98. A spring 132 and washers 134 disposed about pin 128 between bracket 126 and flange 130 bias the bracket and flange apart along the pin. In the absence of a counteracting gas pressure within bags 120, this bias raises bracket 126 and collapses air bags 120 between plates 122 and 124. Pin 128 extends beneath flange 130 and through metal retainers 136 and 138 crimped to air bag 120 at the edge thereof. Nuts 140 threadedly mounted on pin 128 secure the retainers 136 and 138 to the pin. Retainer 138 adjacent air line 92 includes a terminal block 142 connected to the air lines for admitting pressurized air into air bags 120. Each terminal block is connected to one air line 92 which are arranged in a criss-cross manner shown in FIG. 3 to avoid crimping air lines 92. Air bag 120 including edge retainers 136 and 138 and terminal block 142 is commercially available from Merriman Products, Inc., Jackson, Mich., under the trade designation Windjammer.

The operation of the fluidization apparatus 10 in combination with foundry flask 12 will now be described. With plenum box 50 in the outboard position shown in FIG. 1, flask 12 is conveyed along conveyor 14 and stopped at the work station such that flask base chamber 30 registers with rails 52 of fluidization apparatus 10. In this position, rails 52 and flask base platform 26 are coplanar and cooperate to form a slidable track for plenum box 50. Pressurized air is introduced into cylinder 60 through line 84 to advance shuttle 62 in the direction of flask 12 until yoke 66 engages stop 88, thereby sliding skids 112 over rails 52 and flask base platform 26 and pushing plenum box 50 into flask base 24 to the inboard position shown in FIG. 2. In the inboard position, plenum box 50 is arranged within flask base chamber 30 such that plenum outlet 104 registers with frame opening 46 of flask partition 20 and seal bead 108 lies adjacent frame 38, but spaced apart therefrom by the clearance provided to facilitate movement into the flask base, as shown in FIGS. 3 and 4. Pressurized air flow is terminated through line 84 and commenced through line 92, whereupon air bags 120 of pneumatic lifts 118 inflate in response to the increased air pressure to engage brackets 126 to flask platform 26 and to raise plenum box 50 to the position shown in FIG. 5. As plenum box 50 is raised, brackets 126 and guide flange 130 slide relatively together along pin 128, compressing spring 132. In the connection between plenum box 50 and air cylinder shuttle 62, shown in FIGS. 5 and 6, pin 70 slides within bore 80 to accommodate the lifting of plenum box 50. The box is raised by a distance at least sufficient to overcome the clearance between seal bead 108 and flask partition 20 and to urge bead 108 against frame 38 to form a hermetic seal therebetween about plenum outlet 104.

With the box in the raised position shown in FIG. 5, pressurized air is introduced through air lines 90 into plenum chamber 100 and flows past outlet 104 through filter 106 and thereafter through screen 34 and wire mesh laminate 32 into sand bed 18. The resultant upward flow of air through sand bed 18 imparts an upward force to the sand particles which, in cooperation with the downward gravitational force, creates a state of fluidization therein. Plenum chamber 100 distributes the air flowing through partition 20 to produce relatively uniform fluidization within bed 18. Two air lines 90 are preferred to convey sufficient air to produce the desired state of fluidization within sand bed 18. Dirt or oil entrained in the pressurized air is entrapped by filter 106 to prevent plugging of wire mesh laminate 32.

Fluidization is continued for a suitable time to allow a desired task, such as embedding a polystyrene pattern or removing a product casting, to be completed. Thereafter, the flow of pressurized gas through line 90 is terminated to cease fluidization. Pressurized gas to inflatable bags 120 is discontinued and the bags are vented through line 92 to reduce the gas pressure therein, whereupon springs 132 act upon bracket 126 to collapse air bags 120 and lower plenum box 50. Box 50 is returned to the position shown in FIGS. 3 and 4, wherein skids 112 rest upon flask base platform 26. Pressurized air is introduced into cylinder 60 through line 82, whereupon shuttle 62 is retracted and pulls plenum box 50 from flask 12. Shuttle 62 moves until stop 86 is engaged, whereupon plenum box 50 is returned to the position shown in FIG. 1, thereby freeing flask 12 for conveyance to a next work station.

In the outboard position shown in FIG. 1, plenum box 50 is conveniently accessible for periodic maintenance. As dirt and oil accumulate on filter 106, the filter may be replaced by removing bolts 110. When the filter is removed, the interior of plenum box 50 is accessible for wiping to remove any dirt and oil accumulating therein. Also, seal member 108 may be conveniently replaced, if necessary, concurrent with the filter to maintain a hermetic seal about plenum outlet 104 to aid in forcing air into sand bed 18. This maintenance is performed on the fluidization apparatus, in contrast to the foundry flask 12. Because filter 106 reduces plugging of partition 20, maintenance required for flask 12 is reduced or even eliminated.

One advantage of the described embodiment is the use of compressed air not only to fluidize the sand bed, but also to reciprocate the plenum box between the inboard and outboard positions and to raise the plenum box to confront the permeable partition in the flask for fluidization. Thus, the fluidization apparatus is suitably actuated by a single remote gas compressor, not shown in the figures, connected to the several air lines. Valves in the air lines are selectively opened or vented at appropriate sequential times to cause the plenum box to engage the foundry flask and thereafter withdraw therefrom. However, electrical, mechanical or other suitable means may be provided for moving the plenum box between the inboard and outboard positions and for raising the plenum box to confront the permeable partition within the foundry flask. Pressurized air is inexpensive and commonly available in large quantities from a suitable compressor, and is therefore preferred for fluidization, although other gases, for example, from a bottled source, may be suitable.

Although in the described embodiment, the plenum box slid along skids between the inboard and the outboard positions, wheels may be employed to facilitate movement of the box between the inboard and outboard positions.

While this invention has been described in terms of certain embodiments thereof, it is not intended to be limited to said embodiments, but rather only to the extent set forth in the claims that follow.

The embodiments of the invention in which an exclusive property or privilege is claimed are defined as follows:

1. A fluidization gas delivery apparatus for use in conjunction with a flask containing a particulate bed to subject said particulate bed to a forceful gas flow to fluidize the bed, said flask comprising a gas-permeable partition for admitting fluidizing gas to the bed and having an open chamber providing access to the partition opposite the particulate bed, said permeable partition being susceptible to plugging by contaminants entrained in gas flowing therethrough, said apparatus comprising a plenum box receivable within the flask chamber adjacent the permeable partition and defining a plenum having a gas outlet, said plenum box being reciprocal between an outboard position wherein the box is independent of the flask and an inboard position wherein the box is received within the flask chamber with the plenum outlet facing the partition, seal means disposed about the plenum outlet for forming a peripheral hermetic seal when urged against the flask partition, means for reciprocating the plenum box between the inboard and the outboard positions, said box reciprocation being facilitated by suitable clearance provided between the flask partition and the seal means, lift means mounted upon the plenum box and operative for raising the box within the flask chamber relative toward the partition to urge the seal means against the partition to form the peripheral seal about the plenum outlet, filter means mounted upon the plenum box coextensive with the plenum outlet for removing contaminants from gas flowing from the plenum, and means for introducing pressurized gas into the plenum when the plenum box is peripherally sealed against the flask permeable partition to thereby cause gas to flow from the plenum through the filter and thereafter through the permeable partition into the particulate bed to produce fluidization, said filter removing contaminants entrained in the gas to reduce plugging of the flask partition.

2. A fluidization gas delivery apparatus for use in lost foam metal casting in conjunction with a conveyable foundry flask containing an unbonded refractory particulate bed to fluidize said bed for embedding a vaporizable pattern therein or removing a product casting therefrom, said flask comprising a partition supporting said particulate bed and a platform spaced apart from said partition opposite the particulate bed and having an opening to the space between the partition and the platform for access to the partition opposite the particulate bed, said partition comprising a perforated gas inlet communicating with said flask space for admitting compressed air to the bed to produce fluidization and a gas-impermeable border about said inlet engageably facing said flask space for forming a seal thereagainst, said perforated inlet being susceptible to plugging by contaminants entrained in compressed air, said fluidization apparatus comprising a plenum box defining a plenum having a gas outlet corresponding in size and shape to the flask partition gas inlet and being receivable within said flask to rest upon the platform such that said plenum outlet registers with the partition gas inlet, a resilient seal member mounted upon the plenum box about the plenum outlet in a pattern corresponding in size and shape to the partition border and operative to form a peripheral hermetic seal when urged against said partition border, pneumatically actuated means connected to said plenum box for reciprocating the box between an outboard position wherein the box is independent of the flask for unencumbered conveyance of the flask and an inboard position wherein the plenum box is received within the flask, said plenum box being reciprocal through the opening in the flask with suitable clearance provided between the seal member and the flask partition, pneumatic lift means mounted upon the box and operative in response to increased gas pressure when the plenum box is received within the flask to raise the plenum box above the flask platform into confrontation with the partition, thereby urging the seal means against the partition frame to form a peripheral seal, an air filter replaceably mounted upon the plenum box coextensive with the plenum outlet for removing contaminants from compressed air flowed therethrough, and means for introducing compressed air into the plenum when the plenum box is in sealed confrontation with the flask partition gas intlet, whereby air flows forcefully from the plenum through the air filter to remove entrained contaminants and thereafter through the partition inlet into the particulate bed to cause fluidization.

* * * * *